US008925424B1

(12) United States Patent
Jacobs et al.

(10) Patent No.: US 8,925,424 B1
(45) Date of Patent: Jan. 6, 2015

(54) INTERLINK TORQUE BACKUP SYSTEM WITH EASY RELEASE

(76) Inventors: James L. Jacobs, Duson, LA (US); James B. Jacobs, Breaux Bridge, LA (US)

( * ) Notice: Subject to any disclaimer, the term of this patent is extended or adjusted under 35 U.S.C. 154(b) by 250 days.

(21) Appl. No.: 12/783,422

(22) Filed: May 19, 2010

(51) Int. Cl.
*B25B 9/00* (2006.01)
*B25B 13/28* (2006.01)

(52) U.S. Cl.
USPC ..... 81/13; 81/55

(58) Field of Classification Search
CPC .... B25B 23/0085; B25B 23/00; B25B 23/10; B25B 13/48; B25B 9/00
USPC ..... 81/13, 55, 125, 487, 57.29
See application file for complete search history.

(56) References Cited

U.S. PATENT DOCUMENTS

| | | | | |
|---|---|---|---|---|
| 3,351,116 | A | 11/1967 | Madsen | |
| 4,104,936 | A | 8/1978 | Sjostrom | |
| 4,274,310 | A | 6/1981 | Michaud | |
| 4,329,097 | A | 5/1982 | Steele et al. | |
| 4,475,857 | A | 10/1984 | Hiraiwa | |
| 4,735,533 | A | 4/1988 | Gallagher et al. | |
| D305,927 | S | 2/1990 | Linderman et al. | |
| 5,415,509 | A | 5/1995 | Martin et al. | |
| 5,429,465 | A | 7/1995 | Puskas | |
| 5,954,466 | A * | 9/1999 | Coffey et al. | 411/119 |
| 6,427,558 | B1 | 8/2002 | DeLand | |
| 8,020,472 | B2 * | 9/2011 | Kelly et al. | 81/125 |
| 8,074,538 | B2 * | 12/2011 | Gilgallon et al. | 81/57.29 |
| 2008/0202292 | A1 * | 8/2008 | Gilgallon et al. | 81/57.29 |
| 2009/0025516 | A1 * | 1/2009 | Samudosky | 81/57.11 |

OTHER PUBLICATIONS

Hytorc, Hydraulic and Manual—Back Up Wrenches, "24/7 Worldwide Services!," Feb. 25, 2010 http://www.hytorc.com/en/backup-wrenches, 1 page.
A&W Devices, "The Backup Wrench," 2009, Feb. 25, 2010, http://a-w-devices.com/backup.html, 1 page.
Nibtorque, "Speciality Products," Feb. 25, 2010 http://www.nibtorque.com/id33.html, 2 pages.
Torcup Inc., "TBW Series: Operating and Maintenance Instructions for TBW Series BackUP Wrenches," 2008, 5 pages.

* cited by examiner

*Primary Examiner* — Robert Scruggs
(74) *Attorney, Agent, or Firm* — Douglas W. Rommelmann; Andrews Kurth LLP

(57) ABSTRACT

A tool for facilitating the tightening and torquing (or loosening) of threaded fasteners used to hold together two work pieces. The tool includes one or more units, where each unit has an aperture for gripping a threaded fastener, a hole with a tension bolt extending therefrom, and a shoulder for supporting a tension bolt extending from an adjacent tool during the tightening and torquing of the threaded fasteners.

12 Claims, 7 Drawing Sheets

INTERLINK TORQUE BACKUP SYSTEM WITH EASY RELEASE

FIELD OF THE INVENTION

The subject invention relates to a tool for facilitating the tightening and torquing (or loosening) of threaded fasteners used to hold together two work pieces.

BACKGROUND

Illustrative examples of threaded fasteners used to hold together two work pieces are nuts and bolts used to hold together a flange connection. Installing and removing nuts and bolts from flange connections and the like is often difficult, particularly if the flange connections have been exposed to harsh weather or corrosive conditions, and particularly if the flange connections are several inches in diameter. It is common to employ two persons for tightening and/or loosening the flange connection. One person usually holds a backup wrench to retain the nut or bolt head on one side of the connection to prevent it from rotating, while another person usually uses a second wrench to apply torque to the nut or bolt head on the opposite side of the connection. Each time torque is applied to a bolt/nut combination, the backup wrench is typically jammed against an adjacent bolt/nut combination or some other stationary object. When the torquing process is complete, the backup wrench typically has to be knocked loose using a large hammer. This procedure is not only unsafe, but it is also time consuming, labor intensive, and costly. The present invention provides a tool and method that makes this procedure simpler, safer, faster, and more cost-effective.

There are several patents which disclose various devices for locking a nut or bolt to prevent relative rotation between the nut and bolt. Madsen, U.S. Pat. No. 3,351,116, discloses a pair of inter-engageable plate members having central apertures into which the polygonally-shaped heads of bolts are adapted to be inserted, and whereby the projecting edges or corners of the bolt heads will contact adjoining surface portions of the respective aperture in the plate members in which they are located such that during tightening and torquing of nuts which are in screw-fitted engagement with the bolt shanks, this preventing of rotation of the bolts will facilitate the tightening process by a worker.

Sjostrom, U.S. Pat. No. 4,104,936, discloses a holding device that facilitates the tightening of a screw joint projecting from both sides of a pair of plates. The device includes an arm which, at which one end, features an organ for a torque transmitting engagement with a part belonging to the screw joint, and at the other end, features a lateral stop which includes a cam body or eccentric assembly designed to abut against an edge of at least one plate or flange.

Michaud, U.S. Pat. No. 4,274,310, discloses a torque multiplication device for use in tightening or loosening a nut, lug, bolt head and the like, which employs a planetary transmission of sun, planet, and orbit gear means to multiply the applied torque input to produce an output torque to facilitate and simplify such tightening and loosening.

Steele et al, U.S. Pat. No. 4,329,097, discloses a pair of nut locking cups that engage the external surfaces of a pair of nuts and have an outside radius equal to one-half of the distances between adjacent studs with a locking bar welded to the cups and between adjacent studs.

Hiraiwa, U.S. Pat. No. 4,475,857, discloses a detent apparatus in which a plate has polygonally-sided recesses or cutouts formed at oppositely located edges thereof, each engageable by a close-fitting hexagonal member so as to inhibit relative rotation between the hexagonal members responsive to the application of rotational moments thereto.

Gallagher et al, U.S. Pat. No. 4,735,533, and Linderman et al, Design U.S. Des. Pat. No. 305,927, disclose a locking assembly for locking a nut to a valve body which utilizes a lock plate with a peripheral depending skirt having an opening which surrounds the nut-like portion of a valve bonnet and has a slot spaced from the opening which receives a set screw and a nut to secure the lock plate to the valve body.

Martin et al, U.S. Pat. No. 5,415,509, discloses an adjustable locking plate with a rectangular central aperture defined by upwardly bent straps and opposed arcuate end edges and opposed arcuate slots which receive bolts.

Puskas, U.S. Pat. No. 5,429,465, discloses a retainer structure for preventing relative rotation between a plurality of spaced apart nut-like fasteners utilizing a plurality of apertured plates each having a central polygonal aperture which is placed on a nut-like fastener and having opposed ends that are cut out to surround one-half of the adjacent nut-like fastener.

Coffey et al, U.S. Pat. No. 5,954,466, discloses an anti-rotation clip for preventing rotation of a nut-like member of a flanged connection to facilitate tightening or loosening of the nut-like member and eliminate the need to use two wrenches for tightening or loosening a nut or bolt.

DeLand, U.S. Pat. No. 6,427,558, discloses a reaction cam system, wherein the reaction cam applies a reaction force to a backup wrench coupled between a head of a fastener and an adjacent component. The reaction cam is positioned against the backup wrench and has an inner sleeve removably coupled to a head of the fastener.

SUMMARY OF THE INVENTION

The tool of the present invention includes a plurality of units, where each unit has (1) an aperture for gripping a threaded fastener, such as a nut or the head of a bolt; (2) a hole with a tension bolt extending therefrom; and (3) a shoulder for supporting a tension bolt extending from an adjacent tool during the tightening and torquing (or loosening) of the threaded fasteners.

The plurality of units are preferably mounted on one side of a set of threaded fasteners, such as a set of nuts positioned along the bolt circle of a mating flange, and secured into place by manipulating the threaded tension bolt until it presses against the shoulder of an adjacent unit (or some other stationary object strong enough to withstand the torque force). As one or more threaded tension bolts are manipulated on one or more of the units installed around the circle of the mating flange, all of the units become simultaneously secured in place on one side of the set of threaded fasteners.

When all units are simultaneously secured on one side of the set of threaded fasteners (referred to as the "secured side")), a wrench is used to apply torque to the opposite side of the threaded fasteners (referred to as the "torque side"). As torque is applied to the torque side of a particular threaded fastener, the point of contact between the threaded tension bolt of the unit mounted on the secured side of that threaded fastener against the shoulder of a unit mounted on the secured side of an adjacent threaded fastener prevents the secured side of the threaded fastener from rotating. Once the desired torque is obtained for that particular threaded fastener, the wrench can be moved to the torque side of another threaded fastener without having to move or adjust any of the units mounted on the secured side of the threaded fasteners. Once the desired torque is obtained for all of the threaded fasteners, one or more of the threaded tension bolts can be manipulated to release the pressure securing all of the units, which allows the units to be easily removed from the secured side of the threaded fasteners.

BRIEF DESCRIPTION OF THE DRAWINGS

The accompanying drawings are provided for the purpose of illustration only and are not intended as a definition of the limits of the present invention. The drawings illustrate a preferred embodiment of the present invention, wherein.

DESCRIPTION OF THE INVENTION

While the present invention will be described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the present invention not be limited to the particular embodiments disclosed as the best mode contemplated for carrying out this invention, but that the invention will include all embodiments (and legal equivalents thereof) falling within the scope of the appended claims.

Figure 1:
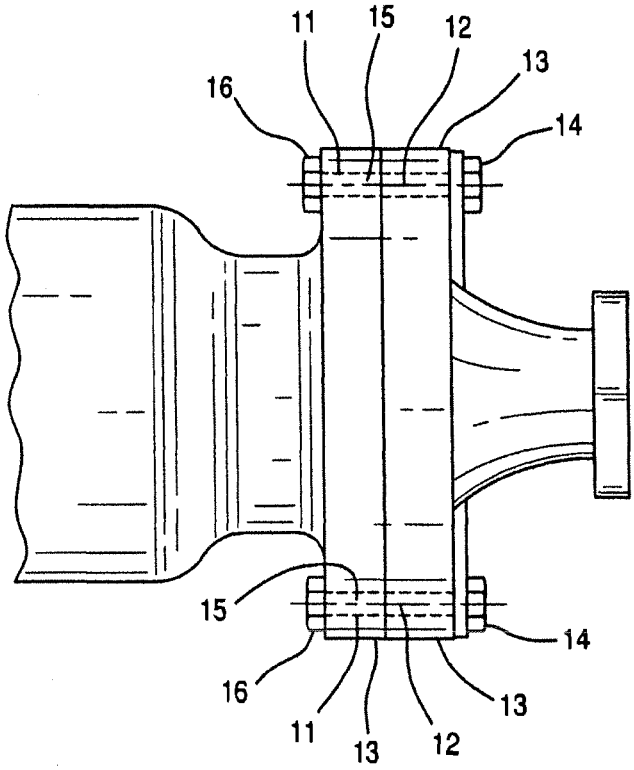
FIG. 1 (Prior Art)
FIG. 1 is a side view of a flange connection.

The present invention relates to a tool and method for tightening and torquing (or loosening) threaded fasteners. An illustrative example of a threaded fastener is a bolt in combination with a nut. The bolt/nut threaded fastener is used extensively in conventional flange connections, as shown in FIG. 1, where a plurality of bolts 11 extend through the bolt holes 12 of mating flanges 13, with complimentary nuts 14 threadably engaged on the bolt shafts 15. A bolt typically has a bolt head 16 attached to a shaft 15, where shaft 15 has a helical groove, or "thread," on its surface. A nut 14 is an object containing a hole with a complimentary threaded helix to mate with the thread of bolt shaft 15. The present invention is primarily designed to facilitate the tightening (or loosening) and torquing of bolt/nut type threaded fasteners used in conventional flange connections.

Figure 2:
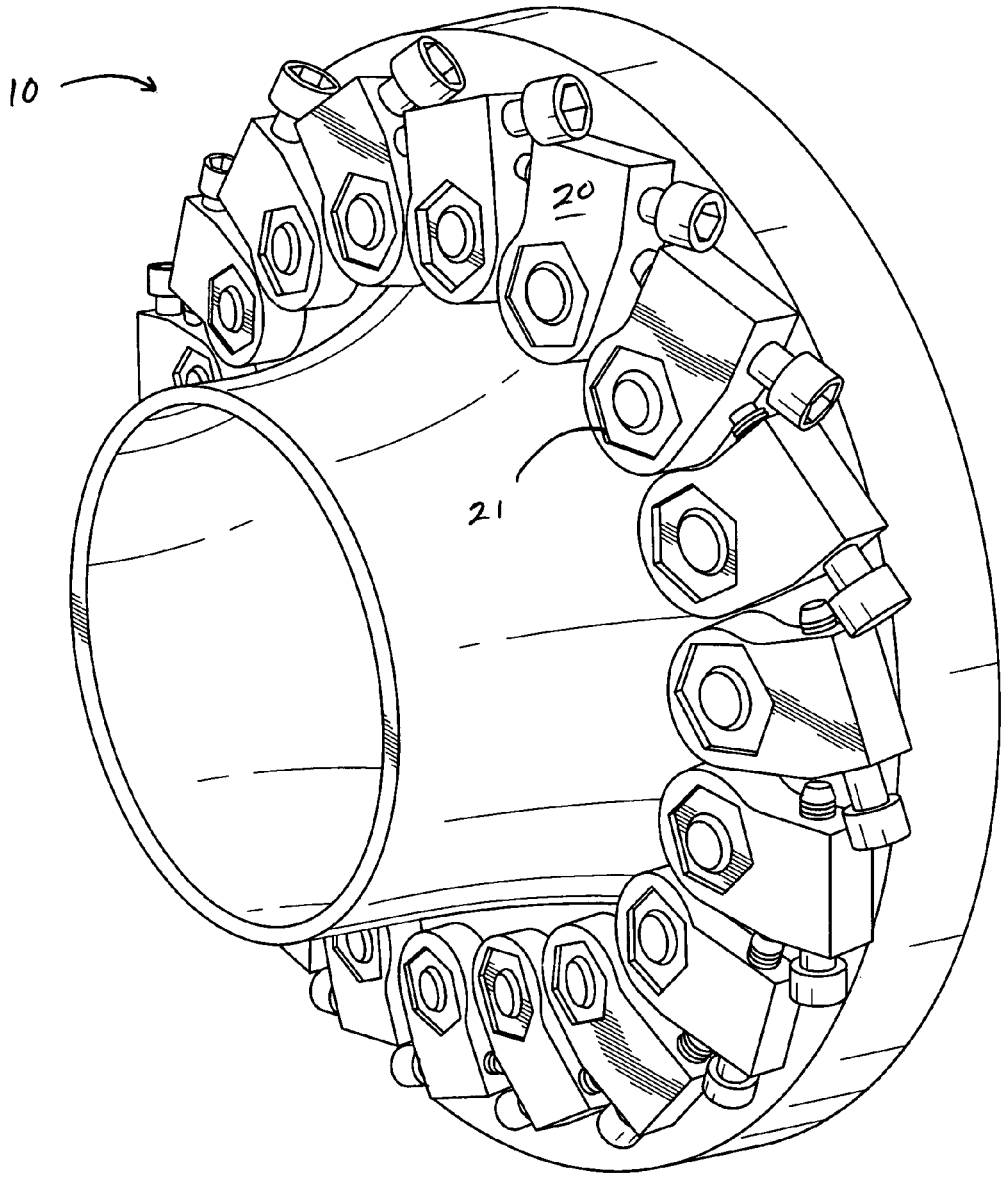
FIG. 2 is a schematic view of the present invention on a flange connection.
Figure 4:
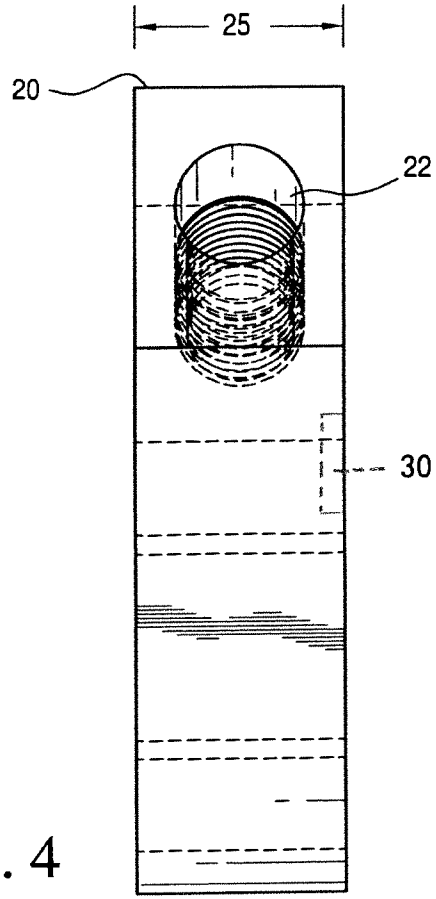
FIG. 4 is a side view of an embodiment of a unit of the present invention.
Figure 3:
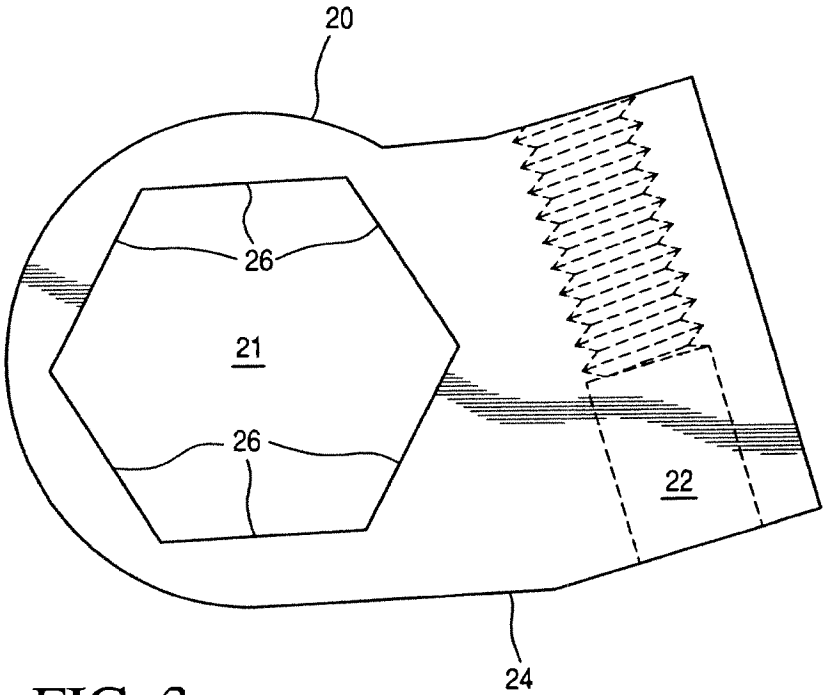
FIG. 3 is a top view of an embodiment of a unit of the present invention.
Figure 6:
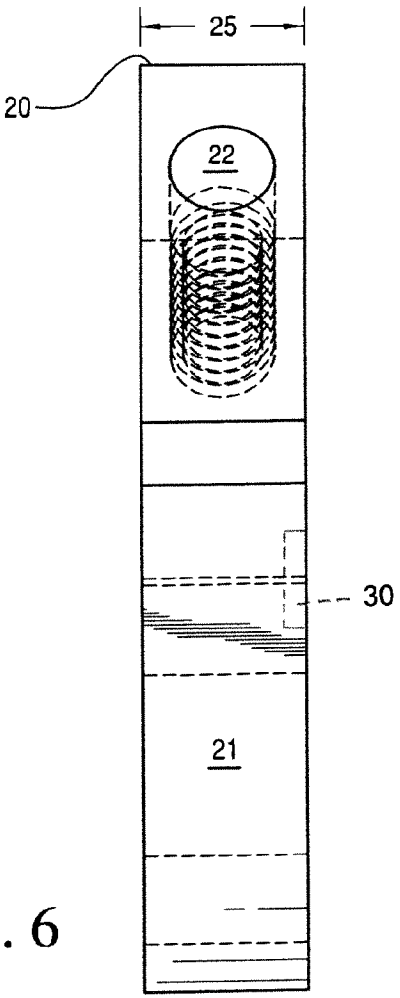
FIG. 6 is a side view of an alternative embodiment of a unit of the present invention.
Figure 5:
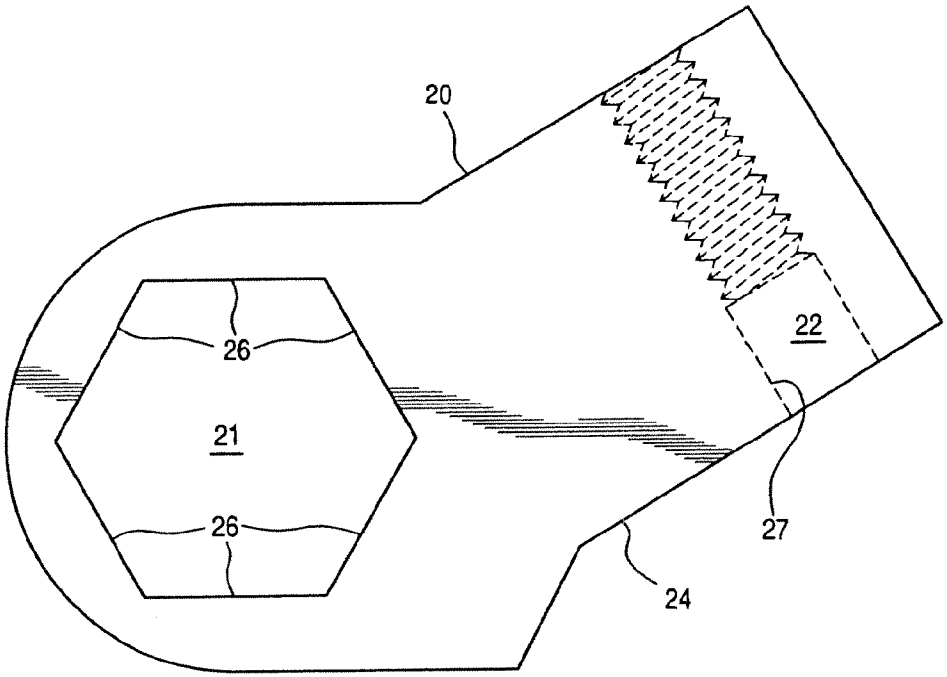
FIG. 5 is a top view of an alternative embodiment of a unit of the present invention.
Figure 8:
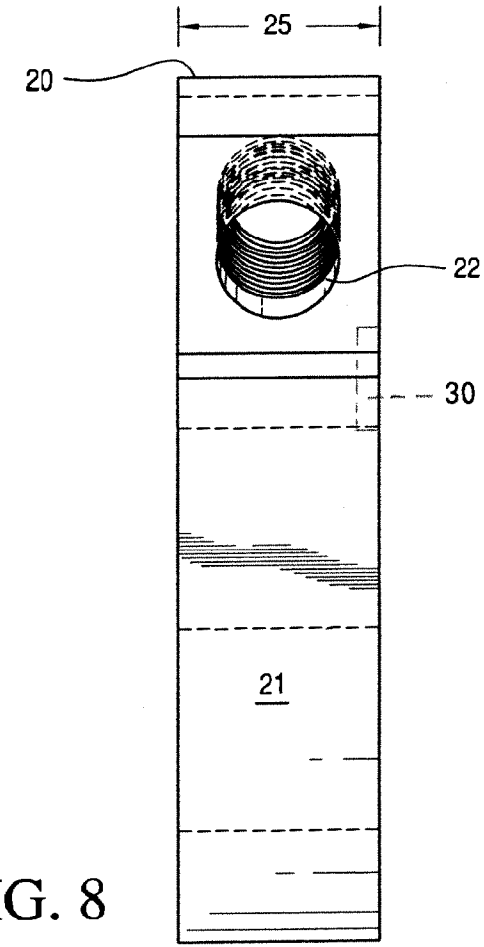
FIG. 8 is a side view of an alternative embodiment of a unit of the present invention.
Figure 7:
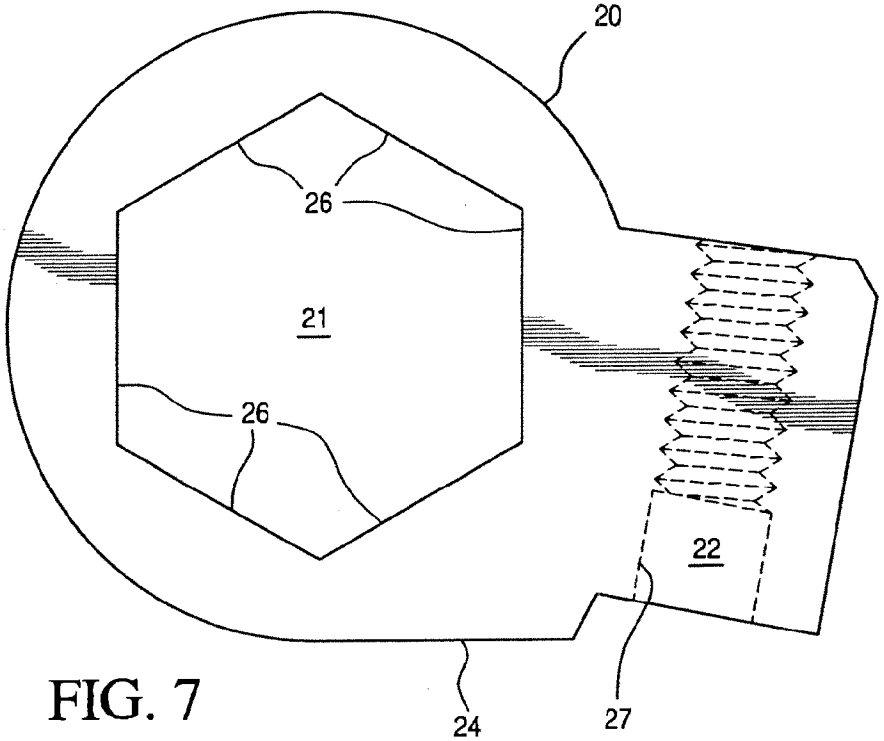
FIG. 7 is a top view of an alternative embodiment of a unit of the present invention.
Figure 10:
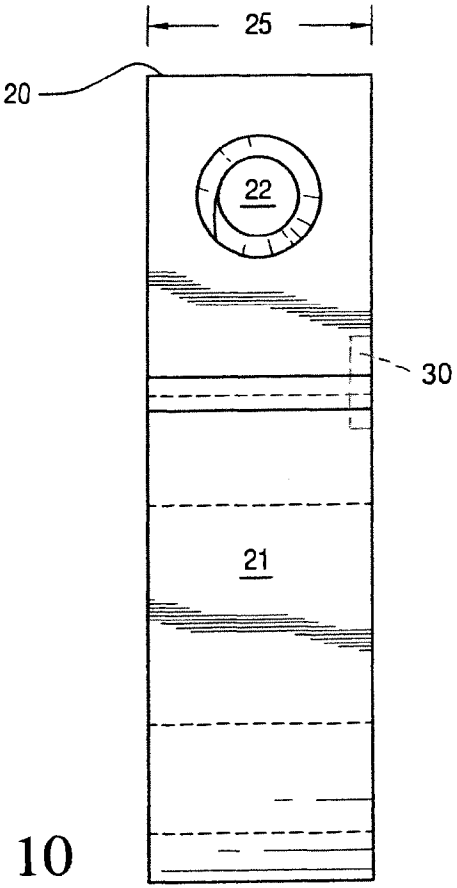
FIG. 10 is a side view of an alternative embodiment of a unit of the present invention.
Figure 9:
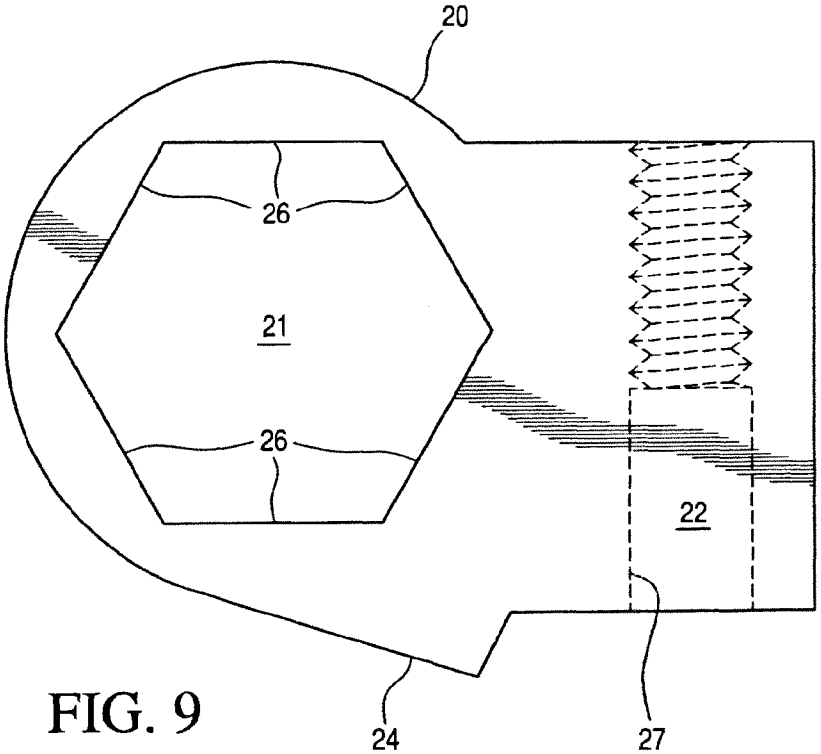
FIG. 9 is a top view of an alternative embodiment of a unit of the present invention.
Figure 13:
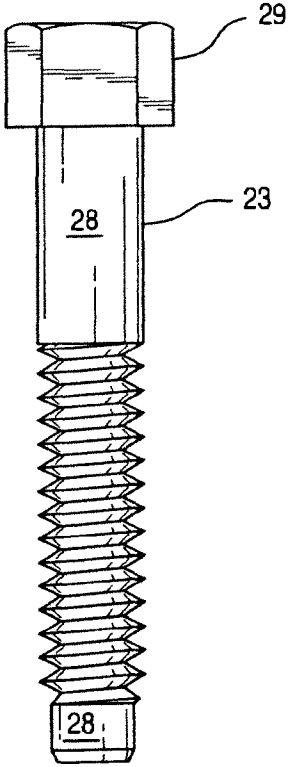
FIG. 13 is a side view of the tension bolt of the present invention.
Figure 12:
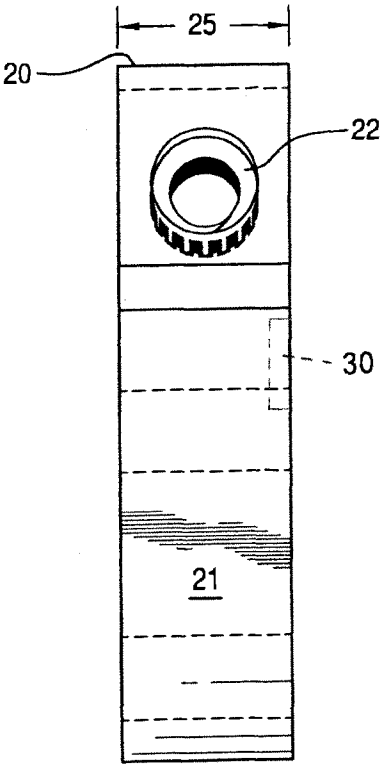
FIG. 12 is a side view of an alternative embodiment of a unit of the present invention.
Figure 11:
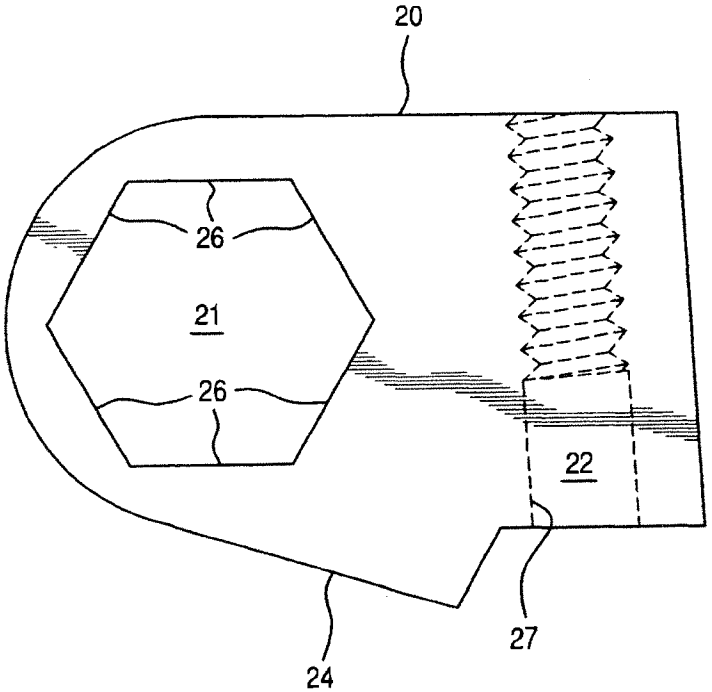
FIG. 11 is a top view of an alternative embodiment of a unit of the present invention.

As shown in FIG. 2, tool 10 of the present invention includes a plurality of units 20, where each unit 20 has an aperture 21 for gripping the elements of a threaded fastener, such as a nut or the head of a bolt. As shown in FIGS. 3 through 12, each unit 20 also has a hole 22 for a tension bolt 23 (shown in FIG. 13) to extend therefrom. Each unit 20 further has a shoulder 24 for supporting a threaded tension bolt 23 extending from an adjacent tool 10 during the tightening and torquing (or loosening) of the threaded fasteners.

Unit 20 can be forged, machined, cast, or produced by other suitable means known to those of ordinary skill in the art. Unit 20 is preferably manufactured from hardened steel, but can also be manufactured from other hard and durable materials, including but not limited to, aluminum and lower or higher grade steel alloys.

As shown in FIGS. 4, 6, 8, 10, and 12, thickness 25 of unit 20 can vary, depending on the size of the threaded fastener to be tightened or loosened. For example, when tightening or loosening nuts or bolt heads ranging in size from approximately 1½ inches to 2½ inches in diameter, thickness 25 of unit 20 is preferably approximately 1 inch to 1½ inches.

As shown in FIGS. 3, 5, 7, 9, and 11, unit 20 can be any geometric shape adapted to fit within any configuration of threaded fasteners. Unit 20 can also be equipped with one or more magnets 30 to prevent unit 20 from falling when the secured side of the threaded fastener is facing downward.

An essentially polygonally-configured aperture 21 preferably extends vertically through unit 20. Aperture 21 preferably has a plurality of discrete angled sides 26 configured to engage the sides of a polygonally-configured threaded fastener, such as a nut or bolt head. As an example, six angled sides 26 are shown in FIGS. 3, 5, 7, 9, and 11, however, it should be understood that aperture 21 may have a greater or lesser number of angled sides 26, depending upon the type of threaded fastener which is to be tightened or loosened.

Hole 22 extends horizontally through unit 20 adjacent to aperture 21. In the preferred embodiment, hole 22 has a threaded helix on its inner wall 27 for receiving a complimentary threaded groove on the shaft 28 of tension bolt 23.

As mentioned above, tension bolt 23 is preferably equipped with a shaft 28, along with a head 29 to facilitate manipulation of tension bolt 23. Shaft 28 preferably has a threaded groove on its outer surface to compliment the threaded helix on inner wall 27 of hole 22. Head 29 of tension bolt 23 can be polygonally-configured with angled sides, but head 29 can be any shape known to those of ordinary skill in the art.

In use, at least one unit 20 is mounted on one side of a set of threaded fasteners, such as a set of nuts positioned along the bolt circle of a mating flange, as shown in FIG. 2. Each unit 20 is secured into place by manipulating tension bolt 23 until it engages shoulder 24 of an adjacent unit 20 (or some other stationary object strong enough to withstand the torque force). As one or more tension bolts 23 are manipulated in this manner, each unit 20 becomes simultaneously secured in place on one side of the set of threaded fasteners.

When all units 20 are simultaneously secured on one side of the set of threaded fasteners (referred to as the "secured side")), a wrench is used to apply torque to the opposite side of the threaded fasteners (referred to as the "torque side"). As torque is applied to the torque side of a particular threaded fastener, the point of contact between tension bolt 23 of a unit 20 mounted on the secured side of that threaded fastener against shoulder 24 of an adjacent unit 20 mounted on the secured side of an adjacent threaded fastener prevents the secured side of the threaded fastener from rotating. Once the desired torque is obtained for that particular threaded fastener, the wrench can be moved to the torque side of another threaded fastener without having to move or adjust any of units 20 mounted on the secured side of the threaded fasteners. Once the desired torque is obtained for all of the threaded fasteners, one or more of tension bolts 23 can be manipulated to release the pressure securing all units 20, which allows each unit 20 to be easily removed from the secured side of the threaded fasteners.

It will be also understood that several embodiments of the present invention have been disclosed by way of example and that other modifications and alterations may occur to those skilled in the art without departing from the scope and spirit of the appended claims.

What is claimed is:

1. A system facilitating the tightening or loosening of at least one threaded fastener of a plurality of threaded fasteners used for holding together two work pieces, the two work pieces having corresponding spatially arranged holes for receiving threaded fasteners having gripping end portions extending from the work pieces, the system comprising:

a first unit having an upper surface, a lower surface and a peripheral edge surface, at least one of said upper and lower surfaces being substantially planer, an aperture for gripping a threaded fastener, said aperture extending from said upper surface to said lower surface, and a hole in said edge surface, said hole extending substantially parallel to said at least one substantially planer surface and separated from said aperture, at least a portion of said hole being threaded;

said first unit including a tension bolt having first and second opposing ends defining a bolt length and a threaded shaft engaging said threaded hole portion, at least a portion of said tension bolt extending outward from said hole at said edge surface; and a second unit having an aperture for gripping a second threaded fastener of the plurality of threaded fasteners, said second unit having a shoulder providing a point of contact with one said end of said tension bolt.

2. The system of claim 1, wherein said first unit further comprises an attached magnet for releasably attaching said first unit to one of the work pieces.

3. The system of claim 2, wherein said first and second units are identical.

4. The system of claim 3, further comprising one said unit for each of the plurality of threaded fasteners.

5. The system of claim 2, wherein said peripheral edge surface of said first unit defines a shoulder adapted to provide a point of contact with an end of a tension bolt of an adjacent unit, and wherein said second unit further comprises an upper surface, a lower surface and a peripheral edge surface, at least one of said upper and lower surfaces being substantially planer, said second unit aperture extending from said second unit upper surface to said second unit lower surface, and a hole in said second unit edge surface, said second unit hole extending substantially parallel to said at least one substantially planer surface and separated from said aperture of said second unit, at least a portion of said second unit hole being threaded, an attached magnet for releasably attaching said second unit to one of the work pieces, and said second unit including a tension bolt having first and second opposing ends defining a bolt length and a threaded shaft engaging said second unit threaded hole portion, at least a portion of said second unit tension bolt extending outward from said hole at said edge surface of said second unit.

6. The system of claim 5, further comprising a plurality of said first and second units corresponding to the plurality of spatially arranged threaded fasteners such that one of said first or second units is capable of being positioned onto each of the plurality of threaded fasteners, wherein with one of said first or second units on each of the plurality of spatially arranged fasteners, each said unit's tension bolt contacts an adjacent said unit's shoulder.

7. The system of claim 1, wherein said first and second units are identical.

8. The system of claim 7, further comprising one said unit for each of the plurality of threaded fasteners.

9. A method facilitating the tightening of a plurality of spatially arranged threaded fasteners for holding together two work pieces using a plurality of units, each unit comprising a member having first and second substantially planer surfaces joined by a peripheral edge surface, an aperture for gripping a threaded fastener, the aperture extending from the first surface to the second surface, and a hole in the edge surface extending substantially parallel to the first surface and separated from the aperture, at least a portion of the hole being threaded, and a tension bolt threadedly engaging the threaded hole portion, the method comprising:

positioning a plurality of units on one of the work pieces by placing one unit's aperture onto the gripping portion of the threaded fastener so that one unit grips one threaded fastener and each of the plurality of spatially arranged threaded fasteners is gripped by a unit;

orienting each of the units so that each tension bolt is directed towards a shoulder of an adjacent unit;

contacting the tension bolt of each unit with the shoulder of an adjacent unit;

rotating the opposite end of one of the plurality of threaded fasteners with the tension bolt of the unit positioned on the one threaded fastener restricting rotational movement of the gripped portion of the threaded fastener.

10. The method of claim 9, further comprising magnetically attaching each unit to one of the work pieces to prevent each unit from falling away from the work piece.

11. The method of claim 9, further comprising rotating the opposite end of each of the plurality of threaded fasteners to a tightened position with the units positioned on the plurality of threaded fasteners.

12. The method of claim 11, further comprising at least partially rotating at least one tension bolt to remove the units from the work piece upon completing the tightening of at least one threaded fastener.

* * * * *